US009455082B2

(12) United States Patent
Tachibana et al.

(10) Patent No.: US 9,455,082 B2
(45) Date of Patent: Sep. 27, 2016

(54) ELECTRONIC COMPONENT

(71) Applicant: MURATA MANUFACTURING CO., LTD., Kyoto (JP)

(72) Inventors: Kaoru Tachibana, Nagaokakyo (JP); Hiroki Hashimoto, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 14/887,455

(22) Filed: Oct. 20, 2015

(65) Prior Publication Data

US 2016/0042862 A1 Feb. 11, 2016

Related U.S. Application Data

(63) Continuation of application No. PCT/JP2014/062097, filed on May 1, 2014.

(30) Foreign Application Priority Data

May 8, 2013 (JP) ..... 2013-098422

(51) Int. Cl.
*H01F 5/00* (2006.01)
*H01F 21/02* (2006.01)
(Continued)

(52) U.S. Cl.
CPC ..... *H01F 27/2804* (2013.01); *H01F 17/0013* (2013.01); *H01F 2027/2809* (2013.01)

(58) Field of Classification Search
USPC ..... 336/147
See application file for complete search history.

(56) References Cited

U.S. PATENT DOCUMENTS 5,251,108 A * 10/1993 Doshita ..... H01F 17/0013 336/200
6,657,530 B2 * 12/2003 Yamagata ..... H01F 17/0013 336/200
7,656,262 B2 * 2/2010 Muto ..... H01F 17/0013 333/25

(Continued)

FOREIGN PATENT DOCUMENTS

JP 2001358016 A 12/2001
JP 2003109830 A 4/2003

(Continued)

OTHER PUBLICATIONS

International Search Report and Written Opinion from PCT/JP2014/062097 dated Aug. 12, 2014.

(Continued)

*Primary Examiner* — Elvin G Enad
*Assistant Examiner* — Ronald Hinson
(74) *Attorney, Agent, or Firm* — Studebaker & Brackett PC

(57) ABSTRACT

An electronic component having; a multilayer body including insulating layers stacked on one another; a spiral coil including coil conductors provided on the insulating layers and a first via-hole conductor piercing through at least one of the insulating layers to connect the coil conductors to each other; a parallel conductor provided on one of the insulating layers; and a second via-hole conductor piercing through at least one of the insulating layers to connect the parallel conductor in parallel to one of the coil conductors provided on the insulating layer different from the insulating layer on which the parallel conductor is provided. A portion of the coil conductor not connected in parallel to the parallel conductor at least partly has a greater width than a portion of the coil conductor connected in parallel to the parallel conductor other than a contact point with the second via-hole conductor.

5 Claims, 7 Drawing Sheets

(51) Int. Cl.
*H01F 27/28* (2006.01)
*H01F 17/00* (2006.01)

(56) References Cited

U.S. PATENT DOCUMENTS

| | | | | |
|---|---|---|---|---|
| 8,427,270 | B2 * | 4/2013 | Maeda | H01F 17/0013 336/147 |
| 2003/0098496 | A1 * | 5/2003 | Sugiyama | H01F 17/0006 257/531 |
| 2007/0296536 | A1 * | 12/2007 | Odahara | H01F 17/0013 336/200 |
| 2009/0184794 | A1 | 7/2009 | Tsuzuki | |
| 2010/0127812 | A1 | 5/2010 | Maeda | |
| 2010/0253464 | A1 * | 10/2010 | Miyoshi | H01F 17/0013 336/200 |
| 2013/0200980 | A1 * | 8/2013 | Yokoyama | H01F 27/292 336/200 |
| 2013/0214891 | A1 | 8/2013 | Maeda | |

FOREIGN PATENT DOCUMENTS

| | | | |
|---|---|---|---|
| JP | 2003158015 | A | 5/2003 |
| JP | 2004342963 | A | 12/2004 |
| JP | 20100245134 | A | 10/2010 |
| JP | 2013162101 | A | 8/2013 |
| WO | 2006073092 | A1 | 7/2006 |
| WO | 2009/016937 | A1 | 2/2009 |

OTHER PUBLICATIONS

An Office Action; "Notification of Reasons for Refusal," issued by the Japanese Patent Office on Jun. 7, 2016, which corresponds to Japanese Patent Application No. 2015-515862 and is related to U.S. Appl. No. 14/887,455; with English language translation.

* cited by examiner

ELECTRONIC COMPONENT

CROSS REFERENCE TO RELATED APPLICATIONS

This application claims benefit of priority to Japanese Patent Application No. 2013-098422 filed May 8, 2013, and International Patent Application No. PCT/JP2014/062097 filed May 1, 2014, the entire content of each of which is incorporated herein by reference.

TECHNICAL FIELD

The present disclosure relates to an electronic component, and more particularly to an electronic component having a multilayer body including insulating layers stacked on one another.

BACKGROUND

As an example of conventional electronic components, a multilayer chip inductor disclosed in Japanese Patent Laid-Open Publication No. 2001-358016 is known. In the multilayer chip inductor, coil patterns are connected to be formed into a coil having a spiral shape. The spiral coil includes some pairs of coil patterns having an identical shape and connected in parallel. Thereby, in the multilayer chip inductor, the DC resistance value of the coil is reduced.

In the multilayer chip inductor disclosed in Japanese Patent Laid-Open Publication No. 2001-358016, since the coil includes some pairs of coil patterns having an identical shape and connected in parallel, the DC resistance value of the coil can be reduced. However, this structure requires a larger number of insulating layers, thereby increasing the height (dimension in the stacking direction) of the multilayer chip inductor.

SUMMARY

An object of the present disclosure is to provide an electronic component having a reduced DC resistance value and a reduced height (a reduced dimension in a stacking direction).

An electronic component according to an embodiment of the present disclosure comprises: a multilayer body including a plurality of insulating layers stacked on one another in a stacking direction; a spiral coil including a plurality of coil conductors provided on the insulating layers and a first via-hole conductor piercing through at least one of the insulating layers in the stacking direction to connect the plurality of coil conductors to each other; a parallel conductor provided on one of the insulating layers on which the coil conductors are provided; and a second via-hole conductor piercing through at least one of the insulating layers in the stacking direction to connect the parallel conductor in parallel to one of the coil conductors provided on the insulating layer different from the insulating layer on which the parallel conductor is provided; wherein a portion of the coil conductor not connected in parallel to the parallel conductor at least partly has a greater width than a portion of the coil conductor connected in parallel to the parallel conductor other than a contact point with the second via-hole conductor.

The present disclosure provides an electronic component having a reduced DC resistance value and a reduced height.

DETAILED DESCRIPTION

In the following, electronic components according to preferred embodiments will hereinafter be described.

Structure of Electronic Component

Figure 1:
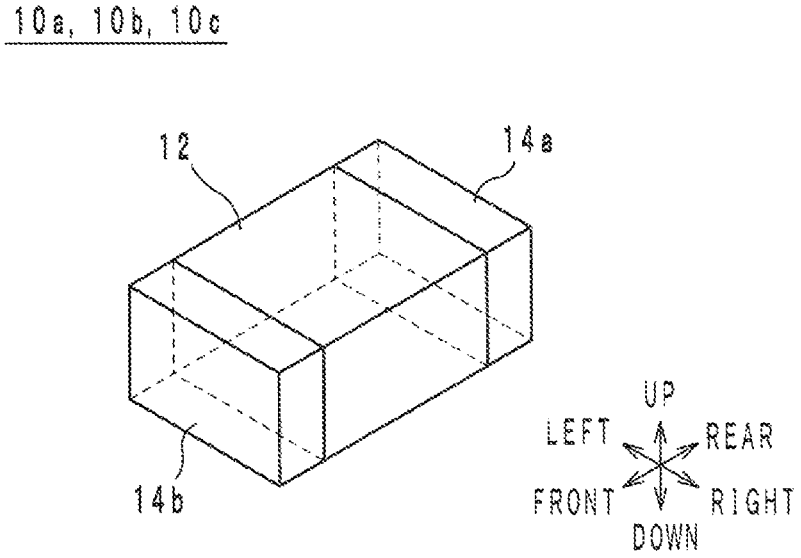
FIG. 1 is a perspective view of an electronic component according to an embodiment.
Figure 2:
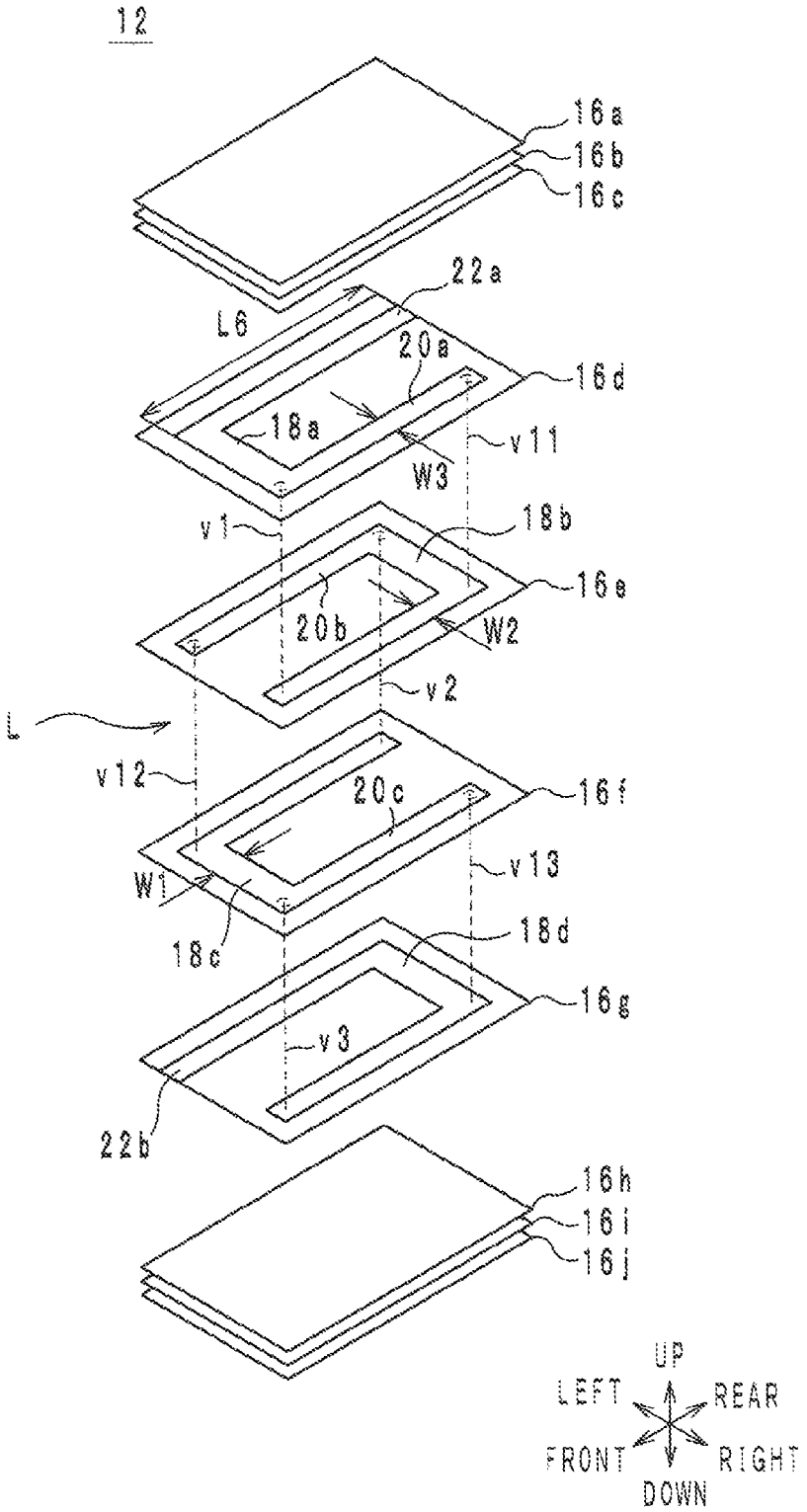
FIG. 2 is an exploded perspective view of a multilayer body of the electronic component.
Figure 3:
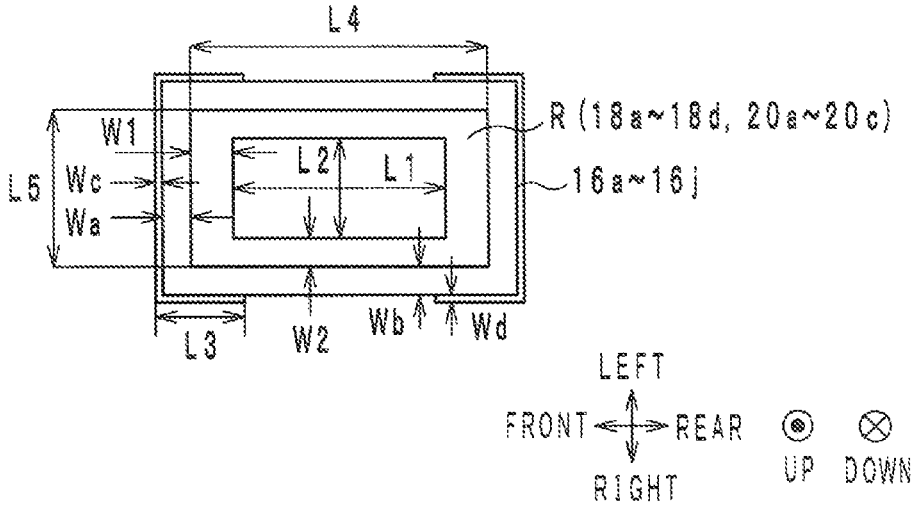
FIG. 3 is a plan view of coil conductors and parallel conductors arranged to overlap one another.

An electronic component according to an embodiment will be described below with reference to the drawings. FIG. 1 is a perspective view of an electronic component 10*a* according to an embodiment. FIG. 2 is an exploded perspective view of a multilayer body 12 of the electronic component 10*a*. FIG. 3 is a plan view of coil conductors 18*a*-18*d* and parallel conductors 20*a*-20*c* arranged to overlap one another. In the following paragraphs, the stacking direction of the electronic component 10*a* is referred to as an up-down direction. In a plan view of the electronic device 10*a* from the upside, the direction in which the longer sides of the electronic device 10*a* extend is referred to as a front-rear direction, and the direction in which the shorter sides of the electronic device 10*a* extend is referred to as a right-left direction.

As seen in FIGS. 1 and 2, the electronic component 10*a* comprises a multilayer body 12, external electrodes 14*a* and 14*b*, parallel conductors 20*a*-20*c*, via-hole conductors v11-v13, and a coil L.

The multilayer body 12 is shaped like a rectangular parallelepiped. The multilayer body 12 includes insulating layers 16*a*-16*j* stacked in this order from the upside to the downside. The insulating layers 16*a*-16*j* are rectangular as seen in FIG. 2, and the insulating layers 16*a*-16*j* are made of a magnetic material, for example, Ni—Cu—Zn-based ferrite. In the following paragraphs, the upper surface of each of the insulating layers 16*a*-16*j* is referred to as a front surface, and the lower surface of each of the insulating layers 16*a*-16*j* is referred to as a back surface.

The coil L includes coil conductors 18*a*-18*d*, lead conductors 22*a* and 22*b*, and via-hole conductors v1-v3. The coil conductors 18*a*-18*d*, the lead conductors 22*a* and 22*b*, and the via-hole conductors v1-v3 are made of a conductive material, for example, an Ag-based material.

The coil conductor 18*a* is a linear conductor turning counterclockwise on the front surface of the insulating layer 16*d*. The coil conductor 18*a* has a length corresponding to a half turn. The coil conductor 18*a* extends along the left longer side and the front shorter side of the insulating layer 16*d*.

The coil conductor 18*b* is a linear conductor turning counterclockwise on the front surface of the insulating layer 16*e*. The coil conductor 18*b* has a length corresponding to a half turn. The coil conductor 18*b* extends along the right longer side and the back shorter side of the insulating layer 16*e*.

The coil conductor 18*c* is a linear conductor turning counterclockwise on the front surface of the insulating layer 16*f*. The coil conductor 18*c* has a length corresponding to a half turn. The coil conductor 18*c* extends along the left longer side and the front shorter side of the insulating layer 16*f*.

The coil conductor 18*d* is a linear conductor turning counterclockwise on the front surface of the insulating layer 16*g*. The coil conductor 18*d* has a length corresponding to a three-quarter turn. The coil conductor 18*d* extends along the right longer side, the rear shorter side and the left longer side of the insulating layer 16*g*.

As illustrated in FIG. 3, the coil conductors 18*a*-18*d* are arranged to overlap one another to form a rectangular path R in a planar view from the upside. In the following paragraphs, the upstream edge of the counterclockwise turn of each of the coil conductors 18*a*-18*d* will be referred to as an upstream edge, and the downstream edge of the counterclockwise turn of each of the coil conductors 18*a*-18*d* will be referred to as a downstream edge.

The via-hole conductor v1 pierces through the insulating layer 16*d* vertically so as to connect the downstream edge of the coil conductor 18*a* to the upstream edge of the coil conductor 18*b*. The via-hole conductor v2 pierces through the insulating layer 16*e* vertically so as to connect the downstream edge of the coil conductor 18*b* to the upstream edge of the coil conductor 18*c*. The via-hole conductor v3 pierces through the insulating layer 16*f* vertically so as to connect the downstream edge of the coil conductor 18*c* to the upstream edge of the coil conductor 18*d*. Accordingly, the coil L is formed into a spiral shape extending downward while turning counterclockwise.

The parallel conductor 20*a* is provided on the front surface of the insulating layer 16*d* on which the coil conductor 18*a* is provided. The parallel conductor 20*a* is a linear conductor extending along the right longer side of the insulating layer 16*d*. The parallel conductor 20*a* is connected to the downstream edge of the coil conductor 18*a*. Thus, the coil conductor 18*a* and the parallel conductor 20*a* that are provided on the same surface of the insulating layer 16*d* are connected to each other. When viewed from the upside, the parallel conductor 20*a* overlaps the portion of the coil conductor 18*b* extending along the right longer side of the insulating layer 16*e*.

The parallel conductor 20*b* is provided on the front surface of the insulating layer 16*e* on which the coil conductor 18*b* is provided. The parallel conductor 20*b* is a linear conductor extending along the left longer side of the insulating layer 16*e*. The parallel conductor 20*b* is connected to the downstream edge of the coil conductor 18*b*. Thus, the coil conductor 18*b* and the parallel conductor 20*b* that are provided on the same surface of the insulating layer 16*e* are connected to each other. When viewed from the upside, the parallel conductor 20*b* overlaps the portion of the coil conductor 18*c* extending along the left longer side of the insulating layer 16*f*.

The parallel conductor 20*c* is provided on the front surface of the insulating layer 16*f* on which the coil conductor 18*c* is provided. The parallel conductor 20*c* is a linear conductor extending along the right longer side of the insulating layer 16*f*. The parallel conductor 20*c* is connected to the downstream edge of the coil conductor 18*c*. Thus, the coil conductor 18*c* and the parallel conductor 20*c* that are provided on the same surface of the insulating layer 16*f* are connected to each other. When viewed from the upside, the parallel conductor 20*c* overlaps the portion of the coil conductor 18*d* extending along the right longer side of the insulating layer 16*g*.

The via-hole conductor v11 pierces through the insulating layer 16*d* vertically so as to connect the rear edge of the parallel conductor 20*a* to the right rear corner of the coil conductor 18*b*. Thereby, the parallel conductor 20*a* is connected in parallel to the coil conductor 18*b*, which is provided on the front surface of the insulating layer 16*e* different from the insulating layer 16*d* on which the parallel conductor 20*a* is provided, through the via-hole conductors v1 and v11. The parallel conductor 20*a* is connected in parallel to the portion of the coil conductor 18*b* forming the right longer side of the path R.

The via-hole conductor v12 pierces through the insulating layer 16*d* vertically so as to connect the front edge of the parallel conductor 20*b* to the left front corner of the coil conductor 18*c*. Thereby, the parallel conductor 20*b* is connected in parallel to the coil conductor 18*c*, which is provided on the front surface of the insulating layer 16*f* different from the insulating layer 16*e* on which the parallel conductor 20*b* is provided, through the via-hole conductors v2 and v12. The parallel conductor 20*b* is connected in parallel to the portion of the coil conductor 18*c* forming the left longer side of the path R.

The via-hole conductor v13 pierces through the insulating layer 16*f* vertically so as to connect the rear edge of the parallel conductor 20*c* to the right rear corner of the coil conductor 18*d*. Thereby, the parallel conductor 20*c* is connected in parallel to the coil conductor 18*d*, which is provided on the front surface of the insulating layer 16*g* different from the insulating layer 16*f* on which the parallel conductor 20*c* is provided, through the via-hole conductors v3 and v13. The parallel conductor 20*c* is connected in parallel to the portion of the coil conductor 18*d* forming the right longer side of the path R.

The portions of the coil conductors 18*b*-18*d* that are not connected in parallel to any of the parallel conductors 20*a*-20*c* have a width W1, and the portions of the coil conductors 18*b*-18*d* that are connected in parallel to any of the parallel conductors 20*a*-20*c* have a width W2. The width W1 is greater than the width W2. More specifically, the parallel conductor 20*a* is connected in parallel to the portion of the coil conductor 18*b* extending along the right longer side of the insulating layer 16*e*. Therefore, the width W1 of the portion of the coil conductor 18*b* extending along the rear shorter side of the insulating layer 16*e* is greater than the width W2 of the portion of the coil conductor 18*b* extending along the right longer side of the insulating layer 16*e*. Further, the parallel conductor 20*a* has a width W3 that is smaller than the width W1 of the portion of the coil conductor 18*b* extending along the rear shorter side of the insulating layer 16*e* and equal to the width W2 of the portion of the coil conductor 18*b* extending along the right longer side of the insulating layer 16*e*.

The parallel conductor 20*b* is connected in parallel to the portion of the coil conductor 18*c* extending along the left longer side of the insulating layer 16*f*. Therefore, the width W1 of the portion of the coil conductor 18*c* extending along the front shorter side of the insulating layer 16*f* is greater than the width W2 of the portion of the coil conductor 18*c* extending along the left longer side of the insulating layer 16*f*. Further, the parallel conductor 20*b* has the width W3 that is smaller than the width W1 of the portion of the coil conductor 18*c* extending along the front shorter side of the insulating layer 16*f* and equal to the width W2 of the portion of the coil conductor 18*c* extending along the left longer side of the insulating layer 16*f*.

The parallel conductor 20*c* is connected in parallel to the portion of the coil conductor 18*d* extending along the right longer side of the insulating layer 16*g*. Therefore, the width W1 of the portion of the coil conductor 18*d* extending along the rear shorter side of the insulating layer 16*g* is greater than the width W2 of the portion of the coil conductor 18*d* extending along the right longer side of the insulating layer 16*g*. Further, the parallel conductor 20*c* has the width W3 that is smaller than the width W1 of the portion of the coil conductor 18*d* extending along the rear shorter side of the insulating layer 16*g* and equal to the width W2 of the portion of the coil conductor 18*d* extending along the right longer side of the insulating layer 16*g*.

The portion of the coil conductor 18*a* extending along the front shorter side of the insulating layer 16*d* has a width equal to the width W1. The portion of the coil conductor 18*a* extending along the left longer side of the insulating layer 16*d* has a width equal to the width W2. Thus, as seen in FIG. 3, the widths of the portions of the coil conductors 18*a*-18*d* forming the shorter sides of the path R are greater than the widths of the portions of the coil conductors 18*a*-18*d* and the parallel conductors 20*a*-20*c* forming the longer sides of the path R.

The widths W3 of the parallel conductors 20*a*-20*c* need not necessarily be equal to the widths W2 of the portions of the coil conductors 18*b*-18*d* that are connected in parallel to any of the parallel conductors 20*a*-20*c*.

The lead conductor 22*a* is provided on the front surface of the insulating layer 16*d* and is connected to the upstream edge of the coil conductor 18*a*. The lead conductor 22*a* leads to the rear shorter side of the insulating layer 16*d*. The lead conductor 22*b* is provided on the front surface of the insulating layer 16*g* and is connected to the downstream edge of the coil conductor 18*d*. The lead conductor 22*b* leads to the front shorter side of the insulating layer 16*g*.

The external electrode 14*a* covers the rear end surface of the multilayer body 12 and is extended to partly cover the four surfaces adjoining the rear end surface. Accordingly, the external electrode 14*a* is connected to the lead conductor 22*a*.

The external electrode 14*b* covers the front end surface of the multilayer body 12 and is extended to partly cover the four surfaces adjoining the front end surface. Accordingly, the external electrode 14*b* is connected to the lead conductor 22*b*.

Production Method of Electronic Component

A method of producing the electronic component 10*a* having the structure above will hereinafter be described with reference to the drawings.

First, ceramic green sheets to be used as the insulating layers 16*a*-16*j* illustrated in FIG. 2 are prepared. Specifically, ferric oxide ($Fe_2O_3$), zinc oxide (ZnO), copper oxide (CuO) and nickel oxide (NiO) at a predetermined ratio by weight are put in a ball mill as raw materials and wet-blended. The obtained mixture is dried and crushed, and the obtained powder is calcined at 800 degrees for one hour. The obtained calcined powder is wet-milled in a ball mill, and thereafter, dried and crushed. In this way, a ferrite ceramic powder is obtained.

A binder (vinyl acetate, water-soluble acrylic or the like), a plasticizer, a wetter and a dispersant are added to the ferrite ceramic powder, and these are mixed together in a ball mill. Thereafter, defoaming of the mixture is carried out by decompression. The obtained ceramic slurry is spread on a carrier sheet to be formed into a sheet by a doctor blade method, and the sheet is dried. In this way, ceramic green sheets to be used as the insulating layers 16*a*-16*j* are obtained.

Next, in the ceramic green sheets to be used as the insulating layers 16*d*-16*f*, the via-hole conductors v1-v3 and v11-v13 are made. Specifically, the ceramic green sheets to be used as the insulating layers 16*d*-16*f* are irradiated with laser beams such that via-holes are pierced in the ceramic green sheets. The via-holes are filled with a conductive paste of Ag, Pd, Cu, Au, an alloy of these metals or the like by printing or any other method.

On the ceramic green sheets to be used as the insulating layers 16*d*-16*g*, the coil conductors 18*a*-18*d*, the parallel conductors 20*a*-20*c* and the lead conductors 22*a* and 22*b* are formed. Specifically, the coil conductors 18*a*-18*d*, the parallel conductors 20*a*-20*c* and the lead conductors 22*a* and 22*b* are formed by applying a conductive paste consisting mainly of Ag, Pd, Cu, Au, an alloy of these metals or the like on the ceramic green sheets to be used as the insulating layers 16*d*-16*g* by screen printing, photolithography or the like. The step of forming the coil conductors 18*a*-18*d*, the parallel conductors 20*a*-20*c* and the lead conductors 22*a* and 22*b* and the step of filling the via-holes with a conductive paste may be executed at the same time.

Next, the ceramic green sheets used as the insulating layers 16*a*-16*j* are stacked in this order as illustrated in FIG. 2 and bonded together. Specifically, the ceramic green sheets used as the insulating layers 16*a*-16*j* are stacked on top of another and tentatively pressure-bonded together. Thereafter, the tentatively bonded unfired mother multilayer body is subjected to final pressure bonding by isostatic pressing or the like. In this way, an unfired mother multilayer body is obtained.

The mother multilayer body is cut into multilayer bodies 12 having specified dimensions. Thereby, unfired multilayer bodies 12 are obtained. The unfired multilayer bodies 12 are subjected to debinding and firing. The debinding is carried out, for example, at 500 degrees C. in a hypoxic atmosphere for two hours. The firing is carried out, for example, at a temperature of 870 to 900 degrees C. for two hours and a half.

Next, each of the multilayer bodies 12 are chamfered by, for example, barreling. Thereafter, silver electrodes to be used as the external electrodes 14*a* and 14*b* are formed by applying a silver-based electrode paste to the surface of the multilayer body 12 by dipping or the like and baking the electrode paste. Baking of the silver electrodes is carried out at 800 degrees C. for one hour.

Finally, the silver electrodes are plated with Ni and Sn, and the external electrodes 14*a* and 14*b* are formed. Through the above-described process, the electronic component 10*a* as illustrated in FIG. 1 is produced.

Advantageous Effects

The electronic component 10*a* according to the embodiment has a reduced height (a reduced dimension in the up-down direction). Specifically, the parallel conductors 20*a*-20*c* are provided on the insulating layers 16*d*-16*f*, respectively, on which the coil conductors 18*a*-18*c* are provided respectively. In the electronic component 10*a*, therefore, it is not necessary to provide additional insulating layers as bases for the parallel conductors 20*a*-20*c*. Accordingly, it is not necessary to increase the height (dimension in the up-down direction) of the electronic device 10*a*.

In the electronic component 10*a*, the coil L has a reduced DC resistance value. Specifically, in the electronic component 10*a*, the parallel conductors 20*a*-20*c* are connected in parallel to the coil conductors 18*b*-18*d*, respectively, through the via-hole conductors v1-v3 and v11-v13 piercing through the insulating layers 16*e*-16*g* vertically. Therefore, two current pathways are formed in the portions where the coil conductors 18*b*-18*d* are connected in parallel to the parallel conductors 20*a*-20*c*, and the DC resistance values in these portions are reduced. The widths W1 of the portions of the coil conductors 18*b*-18*d* that are not connected in parallel to any of the parallel conductors 20*a*-20*c* are greater than the widths W2 of the portions of the coil conductors 18*b*-18*d* that are connected in parallel to any of the parallel conductors 20*a*-20*c*. Thereby, the DC resistance values in the portions of the coil conductors 18*b*-18*d* that are not connected in parallel to any of the parallel conductors 20*a*-20*c* are reduced. Accordingly, the DC resistance value of the coil L can be reduced. As thus far described, in the electronic component 10*a*, the DC resistance value of the coil L can be reduced, and the height (size in the up-down direction) of the electronic device 10*a* can be reduced.

In the electronic device 10*a*, it is possible to reduce a decrease in the inner diameter of the coil L accompanied with the reduction in the DC resistance value of the coil L. Specifically, in an electronic component, a way of reducing the DC resistance value of the coil is, for example, increasing the widths of the coil conductors. However, when the widths of the coil conductors are increased, the inner diameter of the coil will be decreased, and accordingly, the inductance value of the coil will be reduced.

In the electronic device 10*a*, the widths of the portions of the coil conductors 18*a*-18*d* extending along the front and rear shorter sides of the insulating layers 16*d*-16*g* are greater than the widths of the portions of the coil conductors 18*a*-18*d* extending along the right and left longer sides of the insulating layers 16*d*-16*g*. This reduces the decrease in the inner diameter of the coil L and reduces the decrease in the inductance value of the coil L.

Especially in a case in which the axis of the coil L is parallel to the up-down direction and in which the size of the electronic component is small as is the case with the electronic component 10*a*, if the widths of the portions of the coil conductors 18*a*-18*d* extending along the right and left longer sides of the insulating layers 16*d*-16*g* are increased in order to ensure a sufficient inductance value of the coil L, the inner diameter of the coil L will be drastically decreased, as compared to when the widths of the portions of the coil conductors 18*a*-18*d* extending along the front and rear shorter sides of the insulating layers 16*d*-16*g* are increased. Therefore, when it is necessary to increase the widths of the coil conductors 18*a*-18*d*, it is preferred that the widths of the portions of the coil conductors 18*a*-18*d* extending along the front and rear shorter sides of the insulating layers 16*d*-16*g* are increased.

In the electronic component 10*a*, further, instead of increasing the widths of the portions of the coil conductors 18*a*-18*d* extending along the right and left longer sides of the insulating layers 16*d*-16*g*, the parallel conductors 20*a*-20*c* are connected in parallel to the portions of the coil conductors 18*a*-18*d* extending along the right and left longer sides of the insulating layers 16*d*-16*g*. Accordingly, both a reduction in the DC resistance value of the coil L and a reduction in the decrease in the inner diameter of the coil L can be achieved.

Experimental Results

In order to confirm the advantageous effects of the electronic component 10*a*, the inventors conducted an experiment as will be described below.

Figure 4:
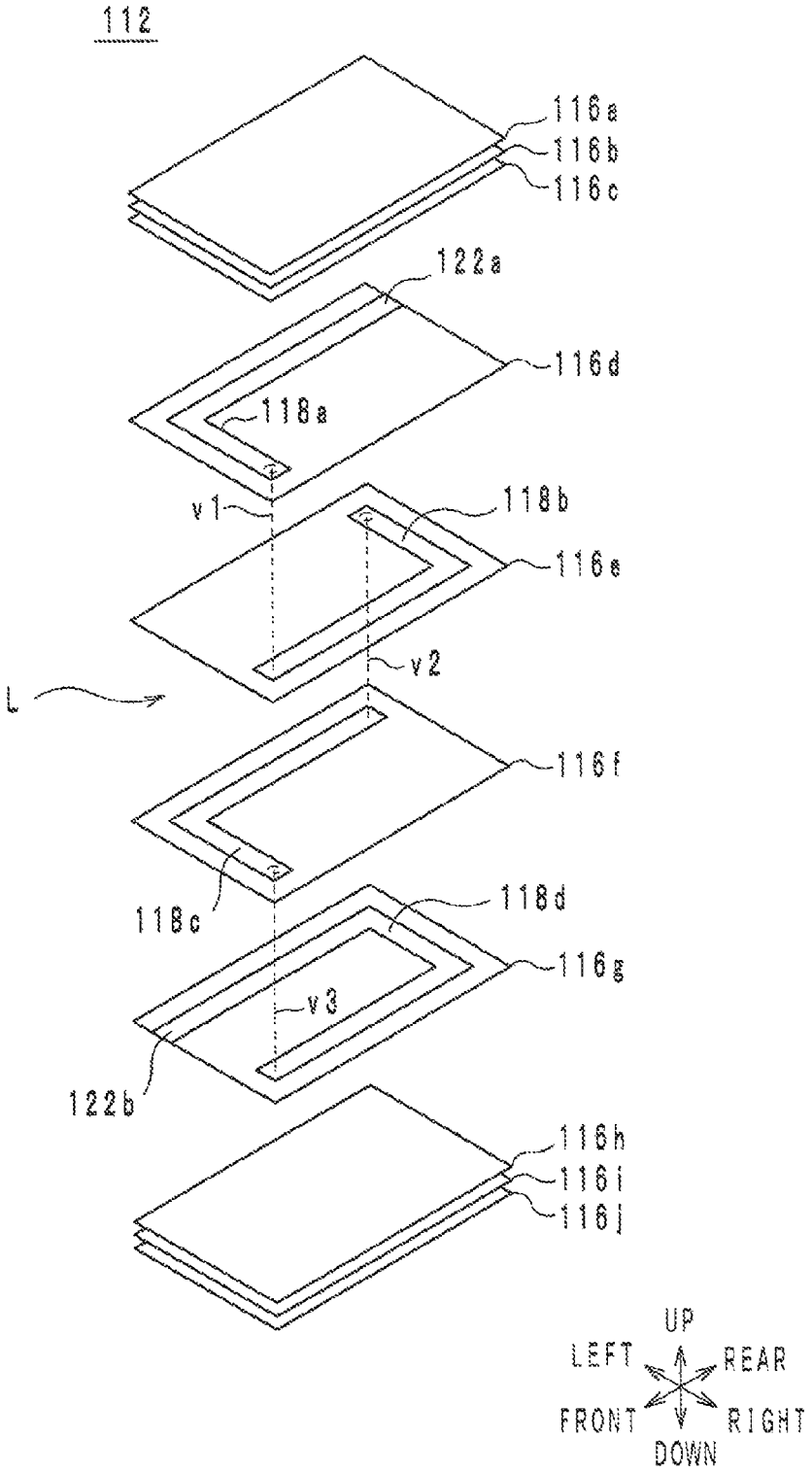
FIG. 4 is a perspective view of a multilayer body of an electronic component according to a comparative example.

The inventors prepared a sample having the same structure as an electronic component 110 as illustrated in FIG. 4. The sample will hereinafter be referred to as a sample according to a first comparative example. The electronic component 110 is different from the electronic component 10*a* in that the parallel conductors 20*a*-20*c* are not provided and that the widths W1 and W2 of the coil conductors are equal to each other (W1=W2=30 μm). The parts of the electronic component 110 are provided with reference symbols provided for the counterparts of the electronic component 10*a* plus 100.

The inventors also prepared a sample having a similar structure to the electronic component 110 illustrated in FIG. 4 and specifically having a double spiral structure including coil conductors 118*a*-118*d* as illustrated in FIG. 4, two conductors each being connected in parallel to each other by via-hole conductors. This sample will hereinafter be referred to as a sample according to a second comparative example. The inventors also prepared a sample having a similar structure to the electronic component 10*a* and specifically a structure in which the widths W1 and W2 of the coil conductors are equal to each other (W1=W2=30 μm). This sample will hereinafter be referred to as a sample according to a third comparative example. The inventor also prepared a sample having the same structure as the electronic component 10*a* and specifically a structure in which the widths W1 of the coil conductors are greater than the widths W2 of the coil conductors (W1>W2, W1=37 μm, W2=28 μm). This sample will hereinafter be referred to as a sample according to a first embodiment. Further, the inventor prepared a sample having a structure in which the widths W1 of the coil conductors are smaller than the widths W2 of the coil conductors (W1<W2, W1=23 μm, W2=32 μm). This sample will hereinafter be referred to as a sample according to a fourth comparative example. In the structures illustrated in FIGS. 2 and 4, the number of turns of the coil L is two and a half. In the samples according to the first comparative example, the third comparative example, the fourth comparative example and the first embodiment, however, three more pairs of coil conductors 18*b* and 18*c* (or 118*b* and 118*c*) were added so that the number of turns of the coil L would become five and a half. In the sample according to the second comparative example, as will be described later, the number of turns of the coil L was set to seven and a half in order to achieve an inductance value (impedance value) near the inductance value (impedance value) achieved by the first comparative example, the third comparative example, the fourth comparative example and the first embodiment. Also, in the samples according to the first embodiment and the fourth comparative example, the widths of the coil conductors were adjusted in order to achieve an inductance value (impedance value) near the inductance value (impedance value) achieved by the first comparative example through the third comparative example.

Referring to FIGS. 2 and 3, the sizes of various parts of the samples according to the first through fourth comparative examples and the first embodiment are described. The following sizes are common to all of the samples according to the first through fourth comparative examples and the first embodiment.

L1 denotes a dimension in the back-rear direction of the inside of the coil L. L2 denotes a dimension in the right-left direction of the inside of the coil L. L3 denotes a dimension of the portion of each of the external electrodes 14*a* and 14*b* extended from the front or rear end surface of the multilayer body 12 or 112 to the adjoining surfaces. L4 denotes a dimension in the front-rear direction of the coil L. L5 denotes a dimension in the right-left direction of the coil L. L6 is a total of the dimension in the front-rear direction of the coil L and the dimension in the front-rear direction of each of the lead conductors 22*a* and 22*b*. Wa denotes a distance between the front shorter side of the annular path R and the front end surface of the multilayer body 12 or 112 or a distance between the rear shorter side of the annular path R and the rear end surface of the multilayer body 12 or 112. Wb denotes a distance between the right longer side of the annular path R and the right end surface of the multilayer body 12 or 112 or a distance between the left longer side of the annular path R and the left end surface of the multilayer body 12 or 112. We denotes a thickness of each of the external electrodes 14*a* and 14*b* on the front or rear end surface. Wd denotes a thickness of each of the external electrodes 14*a* and 14*b* on the right or left end surface. W1 denotes a width of each of the portions of the coil conductors 18*a*-18*d* extending along the front and rear shorter sides. W2 denotes a width of each of the portions of the coil conductors 18*a*-18*d* extending along the right and left longer sides. T (not indicated in the drawings) denotes the number of turns of the coil L. S (not indicated in the drawings) denotes the square measure of the inside of the coil L.

Table 1 below shows the sizes of various parts of the samples according to the first through fourth comparative examples and the first embodiment. The dimensions L1-L6, Wa-Wd, W1 and W2 are indicated in μm. T is indicated in turns. S is indicated in pmt.

TABLE 1

| | L1 (μm) | L2 (μm) | L3 (μm) | L4 (μm) | L5 (μm) | L6 (μm) |
|---|---|---|---|---|---|---|
| Comparative Example 1 | 240 | 70 | 100 | 300 | 130 | 335 |
| Comparative Example 2 | 240 | 70 | 100 | 300 | 130 | 335 |
| Comparative Example 3 | 240 | 70 | 100 | 300 | 130 | 335 |
| Embodiment 1 | 226 | 74 | 100 | 300 | 130 | 335 |
| Comparative Example 4 | 254 | 66 | 100 | 300 | 130 | 335 |

| Wa (μm) | Wb (μm) | Wc (μm) | Wd (μm) | W1 (μm) | W2 (μm) |
|---|---|---|---|---|---|
| 35 | 25 | 15 | 10 | 30 | 30 |
| 35 | 25 | 15 | 10 | 30 | 30 |
| 35 | 25 | 15 | 10 | 30 | 30 |
| 35 | 25 | 15 | 10 | 37 | 28 |
| 35 | 25 | 15 | 10 | 23 | 32 |

The other conditions were as follows.

The electronic component was 0.4 mm in length (dimension in the front-rear direction) and 0.2 mm in width (dimension in the right-left direction). The multilayer body was 0.37 mm in length (dimension in the front-rear direction) and 0.18 mm in width (dimension in the right-left direction). The relative magnetic permeability of the insulating layers was 180. The dielectric constant of the insulating layers was 15. The thickness of each of the insulating layers was 3 μm. The electrical conductivity of the Ag-based conductors was $6.289\times10^{7}$ (S/m). The thickness of each of the coil conductors and the lead conductors was 5 μm. The length (dimension in the up-down direction) of each of the via-hole conductors was 3 μm. The thickness of the outer layer of the multilayer body was 25 μm. The thickness of the outer layer of the multilayer body means the total of the thicknesses of the insulating layers 16*a*-16*c* (or the insulating layers 16*g*-16*j*).

With regard to each of the samples fabricated as described above, the inductance value (μH), the impedance value (Ω) when transmitting a signal of 100 MHz, DC resistance value (Ω), the acquisition efficiency and the height (dimension in the up-down direction) of the electronic component (μm) were measured and calculated. Table 2 indicates the measurement results and the calculation results. The acquisition efficiency is a value obtained by dividing the impedance value by the DC resistance value. For accurate comparison of the samples according to the first through fourth comparative examples and the first embodiment with one another, the samples were fabricated to have substantially the same inductance value and substantially the same impedance value.

TABLE 2

| | Inductance (Ω) | Impedance (Ω) | DC Resistance (Ω) | Acquisition Efficiency | Height (μm) |
|---|---|---|---|---|---|
| Comparative Example 1 | 0.373 | 121 | 0.364 | 332 | 130 |
| Comparative Example 2 | 0.356 | 116 | 0.248 | 468 | 274 |
| Comparative Example 3 | 0.373 | 121 | 0.261 | 464 | 130 |
| Embodiment 1 | 0.372 | 121 | 0.254 | 475 | 130 |
| Comparative Example 4 | 0.373 | 121 | 0.278 | 437 | 130 |

The sample according to the first comparative example had a relatively high DC resistance value of 0.364Ω. As compared to this sample, the sample according to the second comparative example including a pair of coil conductors 118*a*, a pair of coil conductors 118*b*, a pair of coil conductors 118*c* and a pair of coil conductors 118*d*, the conductors in each pair being connected in parallel to each other by via-hole conductors, had a lower DC resistance value (0.248Ω). Meanwhile, since the sample according to the second comparative example included a larger number of coil conductors 118*a*-118*d* stacked on one another than the sample according to the first comparative example, the sample according to the second comparative example had a greater height (274 μm) than the sample according to the first comparative example (130 μm). On the other hand, the DC resistance value of the sample according to the first embodiment was 0.254Ω, which was considerably lower than the DC resistance value of the sample according to the first comparative example (0.364Ω) and relatively near the DC resistance value of the sample according to the second comparative example (0.248Ω). The height of the sample according to the first embodiment was 130 μm, which was lower than the height of the sample according to the second comparative example (274 μm) and equal to the height of the sample according to the first comparative example (130 μm). Thus, the sample according to the first embodiment had a reduced DC resistance value and a reduced height. In the sample according to the first embodiment, the widths W1 of the portions of the coil conductors 18*a*-18*d* extending along the front and rear shorter sides are greater than the widths W2 of the portions of the coil conductors 18*a*-18*d* extending along the right and left longer sides. In the sample according to the third comparative example, on the other hand, the widths W2 of the portions of the coil conductors 18*a*-18*d* extending along the right and left longer sides are equal to the widths W1 of the portions of the coil conductors 18*a*-18*d* extending along the front and rear shorter sides. In the sample according to the fourth comparative example, the widths W2 of the portions of the coil conductors 18*a*-18*d* extending along the right and left longer sides are greater than the widths W1 of the portions of the coil conductors 18*a*-18*d* extending along the front and rear shorter sides. Now, the DC resistance values of the sample according to the third comparative example, the sample according to the fourth comparative example and the sample according to the first embodiment are compared to each other. The DC resistance value of the sample according to the first embodiment was 0.254Ω, which was lower than either of the DC resistance value of the sample according to the third comparative example (0.261Ω) and the DC resistance value of the sample according to the fourth comparative example (0.278Ω), and accordingly, the acquisition efficiency of the sample according to the first embodiment was high.

As a reference against the sample according to the third comparative example in which the widths W2 of the portions of the coil conductors 18*a*-18*d* extending along the right and left longer sides are equal to the widths of the portions of the coil conductors 18*a*-18*d* extending along the front and rear shorter sides (W1=W2=30 μm), a sample in which the widths W1 of the portions of the coil conductors 18*a*-18*d* extending along the front and rear shorter sides are increased from 30 μm to 40 μm was prepared. This sample will hereinafter be referred to as a sample according to a second embodiment. Further, in contrast to the second embodiment, a sample in which the widths W2 of the portions of the coil conductors 18*a*-18*d* extending along the right and left longer sides are increased from 30 μm to 40 μm was prepared. This sample will hereinafter be referred to as a sample according to a fifth comparative example.

TABLE 3

| | L1 (μm) | L2 (μm) | L3 (μm) | L4 (μm) | L5 (μm) | L6 (μm) |
|---|---|---|---|---|---|---|
| Comparative Example 3 | 240 | 70 | 100 | 300 | 130 | 335 |
| Embodiment 2 | 220 | 70 | 100 | 300 | 130 | 335 |
| Comparative Example 5 | 240 | 50 | 100 | 300 | 130 | 335 |

| Wa (μm) | Wb (μm) | Wc (μm) | Wd (μm) | W1 (μm) | W2 (μm) |
|---|---|---|---|---|---|
| 35 | 25 | 15 | 10 | 30 | 30 |
| 35 | 25 | 15 | 10 | 40 | 30 |
| 35 | 25 | 15 | 10 | 30 | 40 |

With regard to each of these samples also, the inductance value (μH), the impedance value (Ω) while transmitting a signal of 100 MHz, the DC resistance value (Ω), the acquisition efficiency and the height (dimension in the up-down direction) of the electronic component (μm) were measured and calculated. Table 4 indicates the measurement results and the calculation results.

TABLE 4

| | Inductance (Ω) | Impedance (Ω) | DC Resistance (Ω) | Acquisition Efficiency | Height (μm) |
|---|---|---|---|---|---|
| Comparative Example 3 | 0.373 | 121 | 0.261 | 464 | 130 |
| Embodiment 2 | 0.342 | 111 | 0.234 | 476 | 130 |
| Comparative Example 5 | 0.267 | 87 | 0.209 | 416 | 130 |

In the sample according to the third comparative example, the square measure S of the inside of the coil L was 16800 μm. In the sample according to the second embodiment, the square measure S of the inside of the coil L was 15400 μm, and as compared to the sample according to the third comparative example, the rate of decrease in the square measure S was about 8%. However, in the sample according to the fifth comparative example, the square measure S of the inside of the coil L was 12000 μm, and as compared to the sample according to the third comparative example, the rate of decrease in the square measure S was about 28%, which was significantly large. Accordingly, the rate of decrease in the inductance value of the sample according to the second embodiment as compared to the third comparative example was smaller than the rate of decrease in the inductance value of the sample according to the fifth comparative example as compared to the third comparative example. Therefore, in the electronic component 10*a*, a decrease in the inductance value can be reduced.

First Modification

Figure 6:
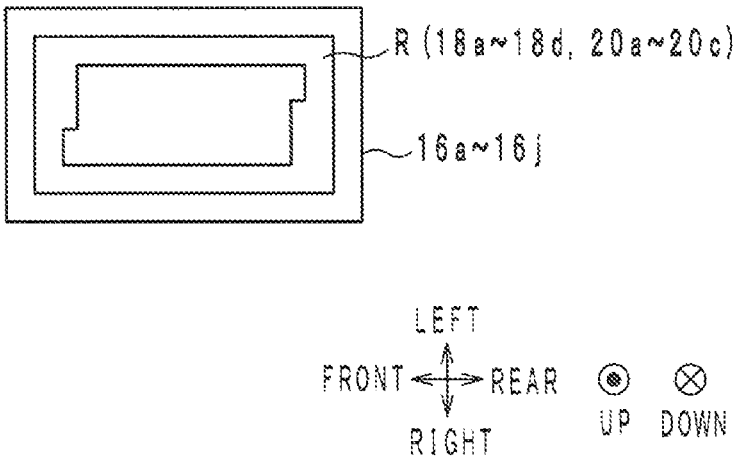
FIG. 6 is a plan view of coil conductors and parallel conductors arranged to overlap one another.

An electronic component 10*b* according to a first modification will hereinafter be described with reference to the drawings. FIG. 4 is an exploded perspective view of the multilayer body 12 of the electronic component 10*b* according to the first modification. FIG. 6 is a plan view of the coil conductors 18*a*-18*d* and the parallel conductors 20*a*-20*c* arranged to overlap one another. The appearance of the electronic component 10*b* is as illustrated in FIG. 1.

Figure 5:
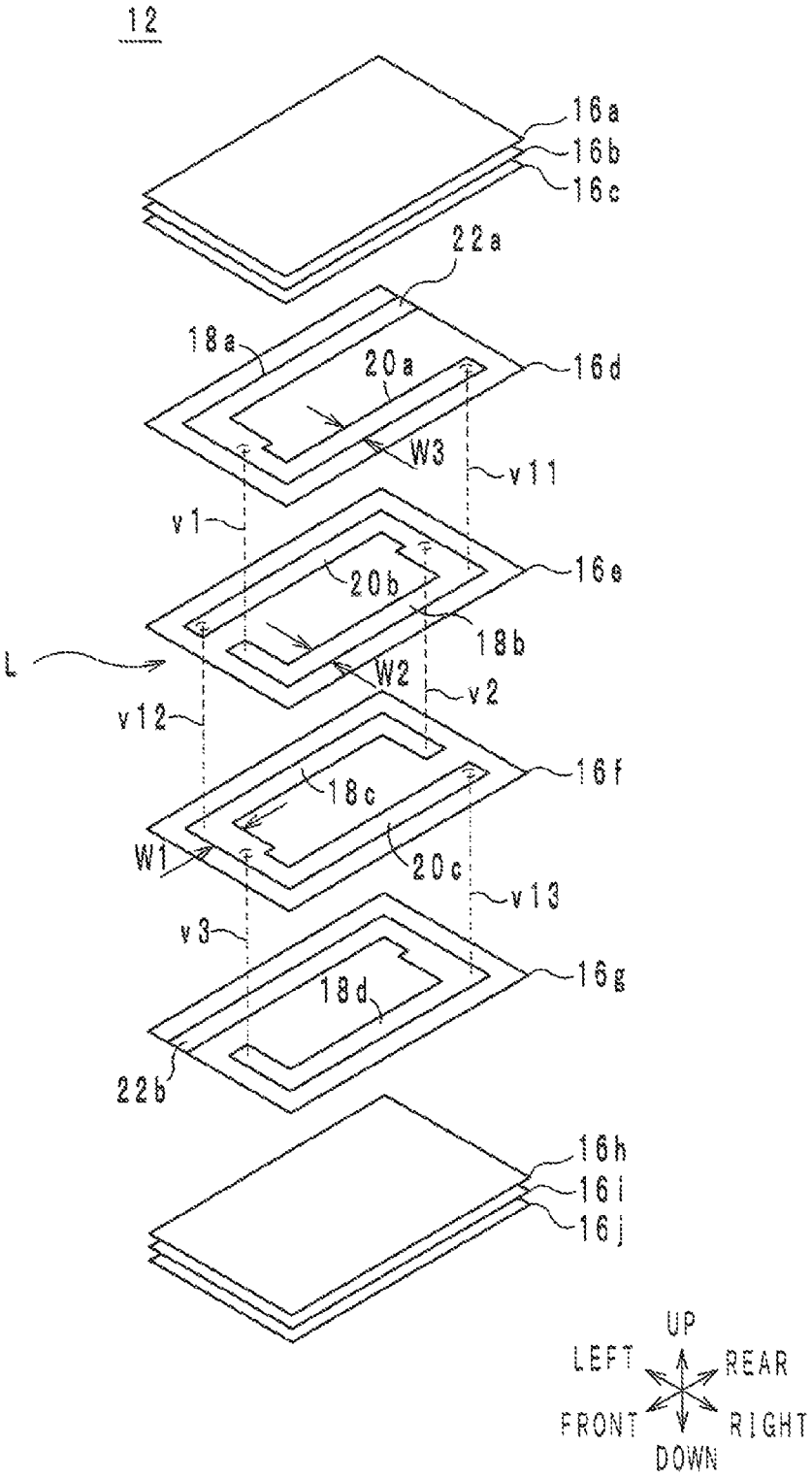
FIG. 5 is a perspective view of a multilayer body of an electronic component according to a first modification.

The electronic component 10*b* is different from the electronic component 10*a* in the shapes of the coil conductors 18*a*-18*d* and the parallel conductors 20*a*-20*c*. More specifically, as seen in FIG. 5, the coil conductor 18*a* has a length corresponding to a three-eighths turn. The portion of the coil conductor 18*a* extending along the left half of the front shorter side of the insulating layer 16*d* has a greater width than any other portion of the coil conductor 18*a*.

Each of the coil conductors 18*b* and 18*c* has a length corresponding to a half turn. The coil conductor 18*b* extends along the right half of the front shorter side, the right longer side and the right half of the rear shorter side of the insulating layer 16*e*. The coil conductor 18*c* extends along the left half of the rear shorter side, the left longer side and the left half of the front shorter side of the insulating layer 16*f*.

The coil conductor 18*d* has a length corresponding to a seven-eighths turn. The conductor 18*d* extends along the right half of the front shorter side, the right longer side, the rear shorter side and the left longer side of the insulating layer 16*g*.

Each of the parallel conductors 20*a*-20*c* has a length corresponding to a three-eighths turn. The parallel conductor

20*a* extends along the right half of the front shorter side and the right longer side of the insulating layer 16*d*. The parallel conductor 20*b* extends along the left half of the rear shorter side and the left longer side of the insulating layer 16*e*. The parallel conductor 20*c* extends along the right half of the front shorter side and the right longer side of the insulating layer 16*f*.

The via-hole conductors v1-v3 and v11-v13 of the electronic component 10*b* are the same as the via-hole conductors v1-v3 and v11-v13 of the electronic component 10*a*, and a description thereof is omitted.

The portions of the coil conductors 18*b*-18*d* that are not connected in parallel to any of the parallel conductors 20*a*-20*c* have a width W1, and the portions of the coil conductors 18*b*-18*d* that are connected in parallel to any of the parallel conductors 20*a*-20*c* have a width W2. The width W1 is greater than the width W2. The coil conductors 18*b*-18*d* and the parallel conductors 20*a*-20*c* of the electronic component 10*b* differ in shape from the coil conductors 18*b*-18*d* and the parallel conductors 20*a*-20*c* of the electronic component 10*a*. Specifically, the portion of the coil conductor 18*b* extending along the right half of the rear shorter side of the insulating layer 16*e* has a greater width than any other portion of the coil conductor 18*b*. The portion of the coil conductor 18*c* extending along the left half of the front shorter side of the insulating layer 16*f* has a greater width than any other portion of the coil conductor 18*c*. The portion of the coil conductor 18*d* extending along the right half of the rear shorter side of the insulating layer 16*g* has a greater width than any other portion of the coil conductor 18*d*. Accordingly, as seen in FIG. 6, the widths of the portions of the coil conductors 18*a*-18*d* forming the left half of the front shorter side of the path R and the portions of the coil conductors 18*a*-18*d* forming the right half of the rear shorter side of the path R are greater than the widths of any other portions of the coil conductors 18*a*-18*d* and the parallel conductors 20*a*-20*c* forming any other portion of the path R.

By virtue of having the above-described structure, as is the case with the electronic component 10*a*, the electronic component 10*b* has a reduced height (a reduced dimension in the up-down direction) and a reduced DC resistance value of the coil L. Also, in the electronic component 10*b*, as is the case with the electronic component 10*a*, the decrease in the inner diameter of the coil L accompanied with the reduction in the DC resistance value of the coil L can be reduced.

Further, the wider portions of the coil L of the electronic device 10*b* are shorter than the wider portions of the coil L of the electronic component 10*a*. Therefore, the inner diameter of the coil L of the electronic component 10*b* is greater than the inner diameter of the coil L of the electronic component 10*a*. Accordingly, the inductance value of the coil L of the electronic component 10*b* is greater than the inductance value of the coil L of the electronic component 10*a*.

Second Modification

Figure 7:
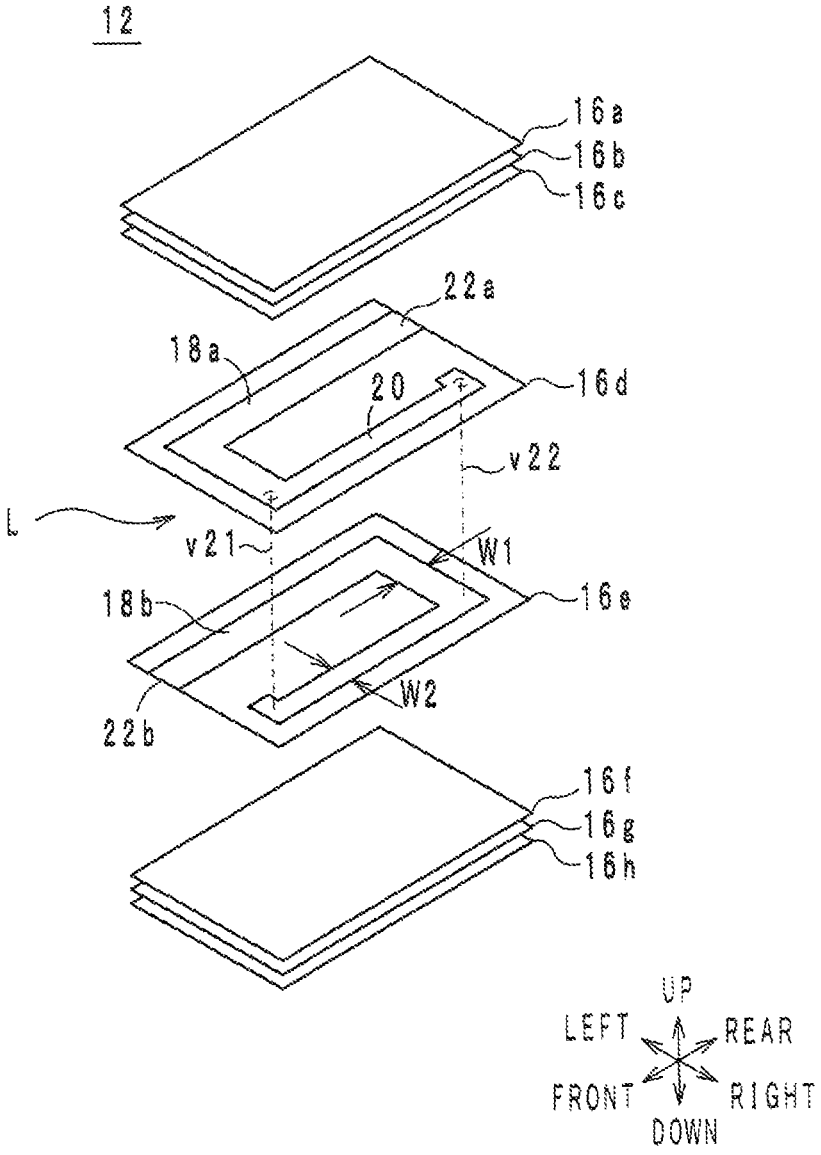
FIG. 7 is a perspective view of a multilayer body of an electronic component according to a second modification.

An electronic component 10*c* according to a second modification will hereinafter be described with reference to the drawings. FIG. 7 is an exploded perspective view of the multilayer body 12 of the electronic component 10*c* according to the second modification. The appearance of the electronic component 10*c* is as illustrated in FIG. 1.

The electronic component 10*c* differs from the electronic component 10*a* in the structure of the coil L. More specifically, the coil L of the electronic component 10*c* includes coil conductors 18*a*, 18*b*, lead conductors 22*a*, 22*b*, and a via-hole conductor v21.

The coil conductor 18*a* is a linear conductor turning counterclockwise on the front surface of the insulating layer 16*d*. The coil conductor 18*a* has a length corresponding to a half turn and extends along the left longer side and the front shorter side of the insulating layer 16*d*.

The coil conductor 18*b* is a linear conductor turning counterclockwise on the front surface of the insulating layer 16*e*. The coil conductor 18*b* has a length corresponding to a three-quarter turn and extends along the right longer side, the rear shorter side and the left longer side of the insulating layer 16*e*.

The coil conductors 18*a* and 18*b* structured above are arranged to overlap each other to form a rectangular path along the outer edges of the insulating layers 16*a*-16*h* in a planar view from the upside. The coil conductors 18*a* and 18*b* are made of a conductive material, for example, an Ag-based material. In the following paragraphs, the upstream edge of the counterclockwise turn of each of the coil conductors 18*a* and 18*b* will be referred to as an upstream edge, and the downstream edge of the counterclockwise turn of each of the coil conductors 18*a* and 18*b* will be referred to as a downstream edge.

The via-hole conductor v21 pierces through the insulating layer 16*d* vertically so as to connect the downstream edge of the coil conductor 18*a* to the upstream edge of the coil conductor 18*b*. Accordingly, the coil L is formed into a spiral shape extending downward while turning counterclockwise.

A parallel conductor 20 is provided on the front surface of the insulating layer 16*d* on which the coil conductor 18*a* is provided. The parallel conductor 20 is a linear conductor extending along the right longer side of the insulating layer 16*d*. The parallel conductor 20 is connected to the downstream edge of the coil conductor 18*a*. Thus, the coil conductor 18*a* and the parallel conductor 20 that are provided on the same surface of the insulating layer 16*d* are connected to each other. When viewed from the upside, the parallel conductor 20 overlaps the portion of the coil conductor 18*b* extending along the right longer side of the insulating layer 16*e*.

A via-hole conductor v22 pierces through the insulating layer 16*d* vertically so as to connect the rear edge of the parallel conductor 20 to the right rear corner of the coil conductor 18*b*. Thus, the parallel conductor 20 is connected in parallel to the coil conductor 18*b*, which is provided on the front surface of the insulating layer 16*e* different from the insulating layer 16*d* on which the parallel conductor 20 is provided, through the via-hole conductors v21 and v22.

The portion of the coil conductor 18*b* that is not connected in parallel to the parallel conductor 20 has a width W1, and the portion of the coil conductor 18*b* that is connected in parallel to the parallel conductor 20, excluding the contact points with the via-hole conductors v21 and v22, has a width W2. The width W1 is greater than the width W2. More specifically, the parallel conductor 20 is connected in parallel to the portion of the coil conductor 18*b* extending along the right longer side of the insulating layer 16*e*. Accordingly, the width W1 of the portion of the coil conductor 18*b* extending along the rear shorter side of the insulating layer 16*e* is greater than the width W2 of the portion of the coil conductor 18*b* extending along the right longer side of the insulating layer 16*e*.

The coil conductor 18*b* and the parallel conductor 20 are connected to each other through the via-hole conductors v21 and v22. In order to secure the contact of the coil conductor

18*b* with the via-hole conductors v21 and v22, the portions of the coil conductor 18*b* around the contact points with the via-hole conductors v21 and v22 are widened. Thus, both ends of the portion of the coil conductor 18*b* extending along the right longer side of the insulating layer 16*e* have an increased width as compared to any other part of the same portion of the coil conductor 18*b*.

By virtue of having the above-described structure, as is the case with the electronic component 10*a*, the electronic component 10*c* has a reduced DC resistance value of the coil L and a reduced height (a reduced dimension in the up-down direction). Also, in the electronic component 10*c*, as is the case with the electronic component 10*a*, the decrease in the inner diameter of the coil L accompanied with the reduction in the DC resistance value of the coil L can be reduced.

Other Embodiments

Electronic components according to the present disclosure are not limited to the electronic components 10*a*-10*c* described above, and various changes and modifications are possible within the scope of the disclosure.

In each of the electronic components 10*a* and 10*b*, it is only necessary that the portions of the coil conductors 18*b*-18*d* that are not connected to any of the parallel conductors 20*a*-20*c* at least partly have the greater width W1 than the width W2 of the portions of the coil conductors 18*b*-18*d* that are connected to any of the parallel conductors 20*a*-20*c*. In the electronic component 10*c*, it is only necessary that the portion of the coil conductor 18*b* that is not connected to the parallel conductor 20 at least partly has the greater width W1 than the width W2 of the portion of the coil conductor 18*b* that is connected to the parallel conductor 20 other than the contact points with the via-hole conductors v21 and v22.

The external electrodes 14*a* and 14*b* of each of the electronic components 10*a*, 10*b* and 10*c* cover the rear end surface and the front end surface, respectively, of the multilayer body 12, and are extended to partly cover the four surfaces adjoining the front end surface and the rear end surface. However, the external electrodes 14*a* and 14*b* may cover the upper surface and the lower surface, respectively, of the multilayer body 12, and may be extended to partly cover the four surfaces adjoining to the upper surface and the lower surface. In this case, the external electrodes may be connected to the coil conductors not by the lead conductors 22*a* and 22*b* but by via-hole conductors piercing vertically through the insulating layers 16*a*-16*c* and 16*h*-16*j*.

In each of the electronic components 10*a* and 10*b*, the parallel conductors 20*a*-20*c* need not necessarily be connected to the coil conductors 18*a*-18*c*, respectively. In the electronic component 10*c*, the parallel conductor 20 needs not necessarily be connected to the coil conductor 18*a*. Instead, by forming via-hole conductors piercing through the insulating layers 16*d*-16*f*, the coil conductors can be connected in parallel to the respective parallel conductors.

In the description above, the path R is defined to have a rectangle shape. The "rectangle" means not only a quadrangle having right-angled corners but also a quadrangle having rounded-off corners. The "rectangle" also includes a track-like shape having two long sides and two circular arcs connecting the ends of the long sides to each other. In this case, the circular arcs correspond to the shorter sides.

Industrial Applicability

As thus far described, the present disclosure is useful to electronic components. The present disclosure has an advantage especially in reducing the height (dimension in a stacking direction) while reducing the DC resistance value.

What is claimed is:

1. An electronic component comprising:

a multilayer body including a plurality of insulating layers stacked on one another in a stacking direction;

a spiral coil including a plurality of coil conductors provided on the insulating layers and a first via-hole conductor piercing through at least one of the insulating layers in the stacking direction to connect the plurality of coil conductors to each other;

a parallel conductor provided on one of the insulating layers on which the coil conductors are provided; and a second via-hole conductor piercing through at least one of the insulating layers in the stacking direction to connect the parallel conductor in parallel to one of the coil conductors provided on the insulating layer different from the insulating layer on which the parallel conductor is provided, wherein:

a portion of the coil conductor not connected in parallel to the parallel conductor at least partly has a greater width than a portion of the coil conductor connected in parallel to the parallel conductor other than a contact point with the second via-hole conductor.

2. The electronic component according to claim 1, wherein:

the parallel conductor is connected to the coil conductor provided on the same insulating layer; and the parallel conductor is connected in parallel to the coil conductor provided on one of the insulating layers different from the insulating layer on which the parallel conductor is provided by the first via-hole conductor and the second via-hole conductor.

3. The electronic component according to claim 2, wherein the portion of the coil conductor not connected in parallel to the parallel conductor at least partly has a greater width than a portion of the coil conductor connected in parallel to the parallel conductor other than the contact point with the first via-hole conductor and a contact point with the second via-hole conductor.

4. The electronic component according to claim 1, wherein:

the insulating layers are rectangular;

the coil conductors are arranged to overlap one another to form a rectangular path along outer edges of the insulating layers when viewed from the stacking direction; and widths of portions of the coil conductors corresponding to a shorter side of the rectangular path are greater than widths of portions of the coil conductors corresponding to a longer side of the rectangular path.

5. The electronic component according to claim 1, wherein:

the insulating layers are rectangular;

the coil conductors are arranged to overlap one another to form a rectangular path along outer edges of the insulating layers when viewed from the stacking direction; and the parallel conductor is connected in parallel to a portion of the coil conductor forming a longer side of the rectangular path.

* * * * *